United States Patent [19]

Smith et al.

[11] Patent Number: 5,051,038

[45] Date of Patent: Sep. 24, 1991

[54] BARRIER PLUG FOR DYNAMIC ROCK STABILIZING FIXTURE

[75] Inventors: Clyde R. Smith, Pittsburgh, Pa.; Clifford A. McCartney, Salem, Va.

[73] Assignee: Ingersoll-Rand Company, Woodcliff Lake, N.J.

[21] Appl. No.: 505,398

[22] Filed: Apr. 6, 1990

[51] Int. Cl.[5] ..... E21D 21/02

[52] U.S. Cl. ..... 405/261; 405/260; 411/39; 411/49; 411/82

[58] Field of Search ..... 405/259, 260, 261; 411/2, 15, 39, 49, 66, 82

[56] References Cited

U.S. PATENT DOCUMENTS

| | | | |
|---|---|---|---|
| 3,108,443 | 10/1963 | Schuermann et al. | 405/261 |
| 3,901,319 | 8/1975 | Staley et al. | 405/261 X |
| 4,400,113 | 8/1983 | Chaiko et al. | 405/261 |
| 4,501,515 | 2/1985 | Scott | 405/259 |
| 4,659,258 | 4/1987 | Scott | 405/261 |
| 4,836,729 | 6/1989 | Bisping et al. | 411/82 |

*Primary Examiner*—David H. Corbin
*Assistant Examiner*—Arlen L. Olsen
*Attorney, Agent, or Firm*—Glenn B. Foster

[57] ABSTRACT

A device for a bore formed in a geological structure, the bore having an outer circumferential wall. A bolt is inserted into the bore. A sleeve secures a first axial portion of the bolt to a first portion of the circumferential wall. Grout secures a second axial portion of the bolt means to a second portion of the circumferential wall; A substantially disk shaped plug limits a passage of grout to between the first axial portion of the bolt and the first portion of the circumferential wall. A retainer is included to retain a grout container in the bore prior to insertion of the bolt means into the bore.

34 Claims, 3 Drawing Sheets

BARRIER PLUG FOR DYNAMIC ROCK STABILIZING FIXTURE

BACKGROUND OF THE INVENTION

This invention relates generally to dynamic rock stabilizing fixtures for mine roof support applications, and more particularly to barrier plugs which limit the flow of grout to desired areas in dynamic rock stabilizing fixtures.

Presently, anchor systems utilize a metal or plastic sleeve which is designed to closely fit within a bore formed in mine roofs. A roof bolt, with a roof plate attached, are designed to be inserted within the sleeve, forcing the sleeve into tight engagement with the side of the bore.

Recently, grout or resin systems have been used in conjunction with the anchor to hold the roof bolt more securely in place. In these systems, the grout secures one axial portion of the roof bolt, and the plastic sleeve secures another portion. In these systems, the grout intermingles with the plastic sleeve portion weakening the attachment between the roof bolt and the bore.

The foregoing illustrates limitations known to exist in present dynamic rock stabilizing fixtures. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an apparatus comprising a bolt inserted into a bore formed in a geological structure, the bore having an outer circumferential wall. A sleeve secures a first axial portion of the bolt to a first portion of the circumferential wall. A retainer is included to retain a grout container in the bore prior to insertion of the bolt means into the bore.

Grout secures a second axial portion of the bolt means to a second portion of the circumferential wall; A substantially disk shaped plug limits a passage of grout to between the first axial portion of the bolt and the first portion of the circumferential wall.

The foregoing and other aspects will become apparent from the following detailed description of the invention when considered in conjunction with the accompanying drawing figures

BRIEF DESCRIPTION OF THE DRAWING FIGURES

DETAILED DESCRIPTION

Figure 1:
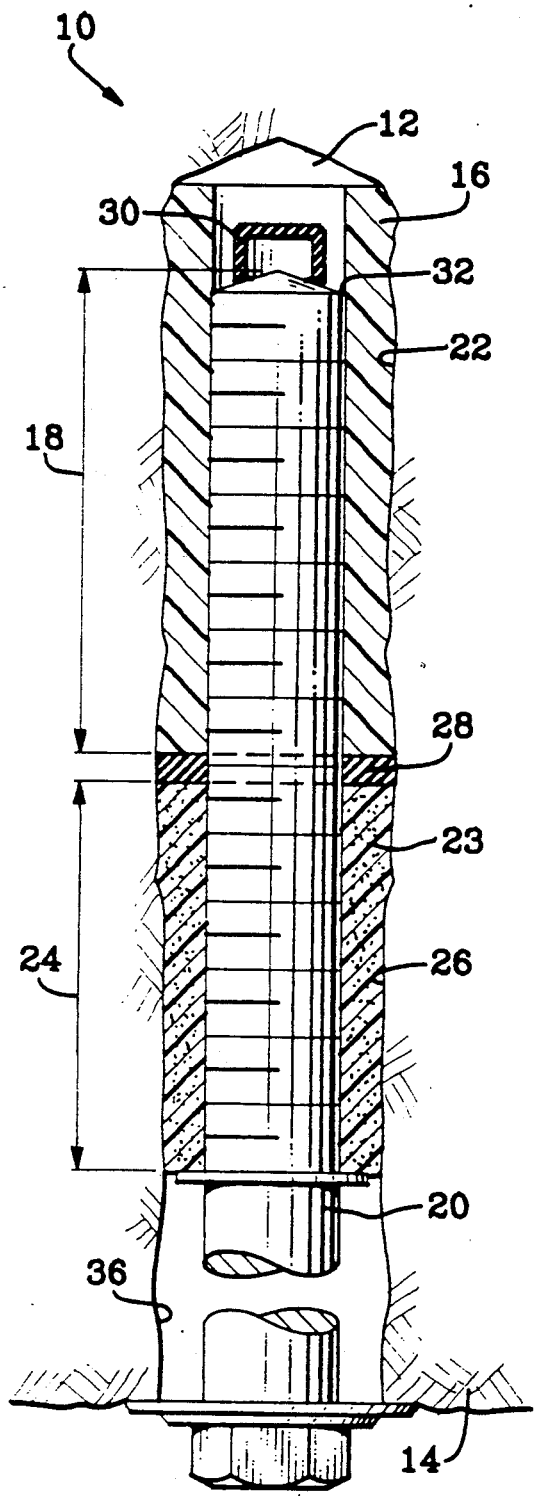
FIG. 1 is a side cross sectional view illustrating an installed dynamic rock stabilizing fixture with one embodiment of a barrier plug of the instant invention.
Figure 2:
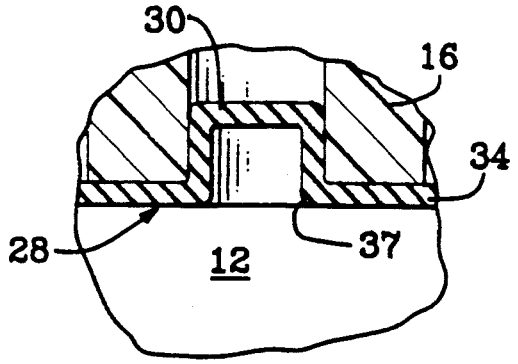
FIGS. 2 to 7 are different embodiments of barrier plugs and sleeve inserted in a bore, prior to insertion of a resin cartridge and a bolt means.
Figure 3:
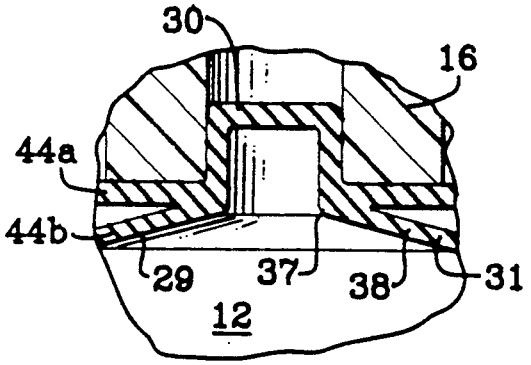
Figure 4:
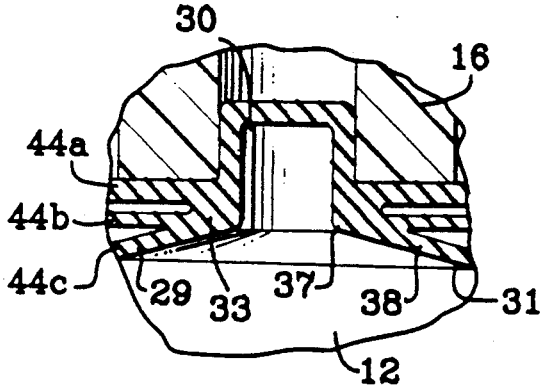

This invention relates to a dynamic rock stabilizing fixture assembly 10, which is designed to be inserted in a bore 12 formed in a geological structure 14. A sleeve means 16 is disposed within the bore 12, and secures a first axial portion 18 of a bolt means 20 to a first portion 22 of the bore 12. A grout or resin means 23 secures a second axial portion 24 of the bolt 20 to a second portion of the bore 26. A combined sleeve means and grout means for securing a roof bolt is shown in U.S. Pat. No. 4,659,258, incorporated herein by reference.

If the grout means flows between the sleeve means 16 and the first portion of the bore 22, then the grout can actually act as a lubricant, and reduce an effective holding force between the sleeve means 16 and the bore 12. To prevent this flow, a substantially disk shaped plug means 28 is attached to one end of the sleeve, and substantially covers the cross sectional area 30 of the bore 12, prior to the insertion of the bolt means into the sleeve means 16.

Figure 5:
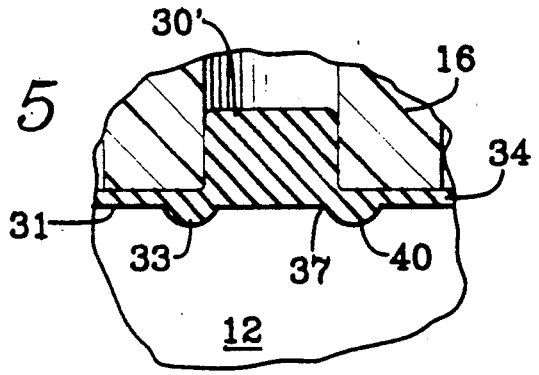
Figure 6:
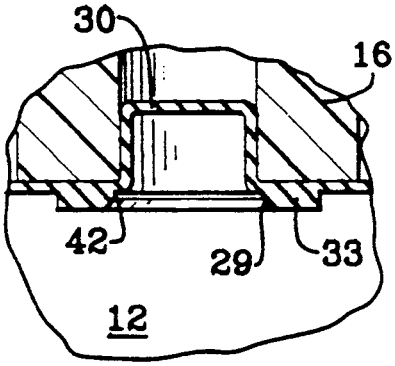
Figure 7:
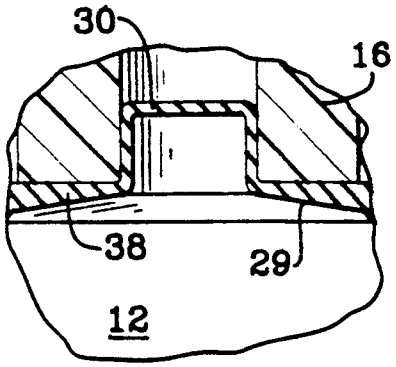
Figure 8A:
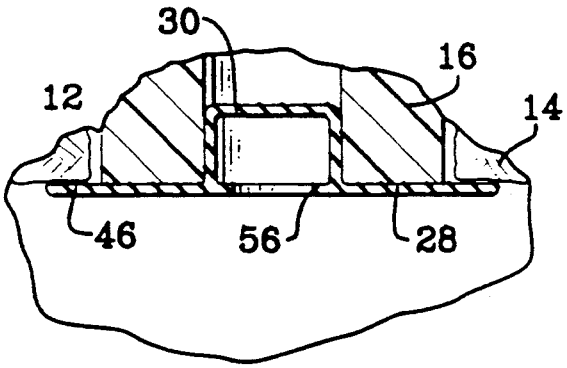
FIG. 8A is another embodiment of a barrier plug and sleeve of the instant invention, partially inserted into a bore.
Figure 8B:
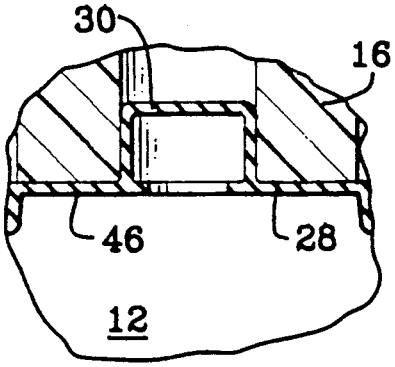
FIG. 8B is the barrier plug and sleeve of FIG. 8A, which is inserted further into the bore.
Figure 9:
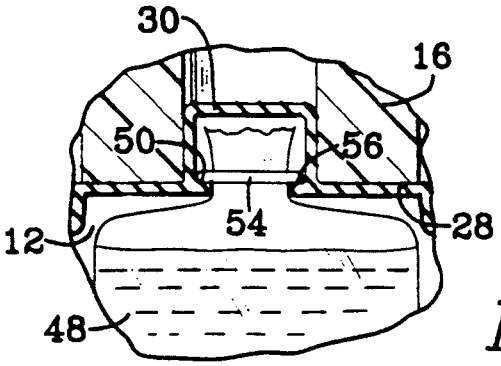
FIG. 9 is the barrier plug and sleeve of FIG. 8A, with a grout container being retained inside the bore by the grout container capture means of the instant invention.
Figure 10:
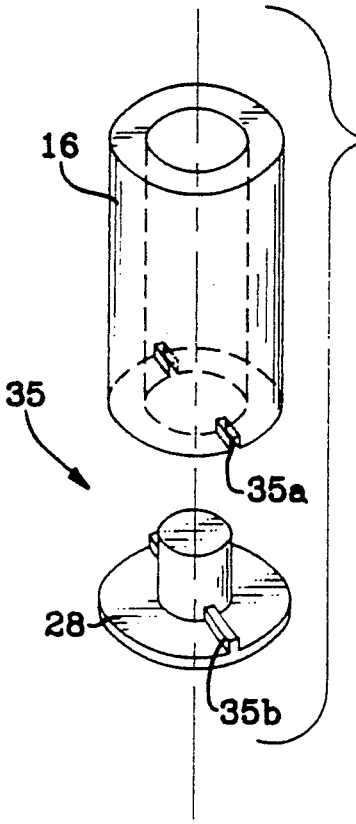
FIG. 10 is an assembly view of yet another embodiment of barrier plug and sleeve, with an engaging means included.
Figure 13:
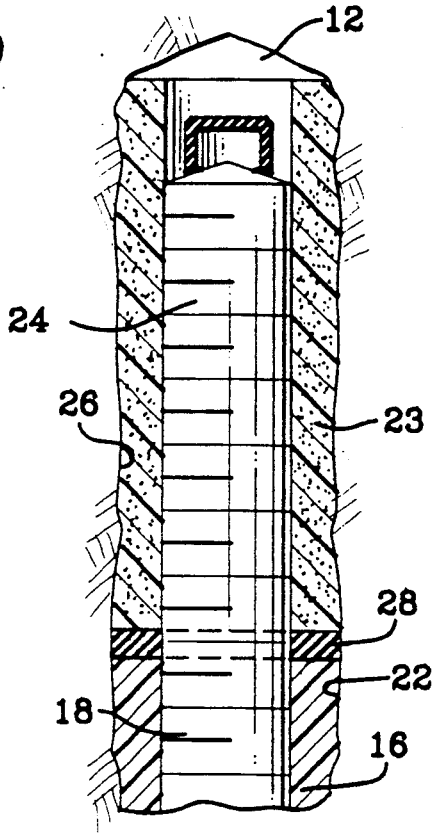
Figure 11:
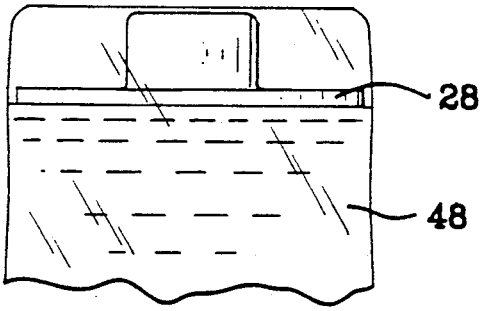
FIGS. 11–12 are alternate embodiments of combined grout containers and plug means.
Figure 12:
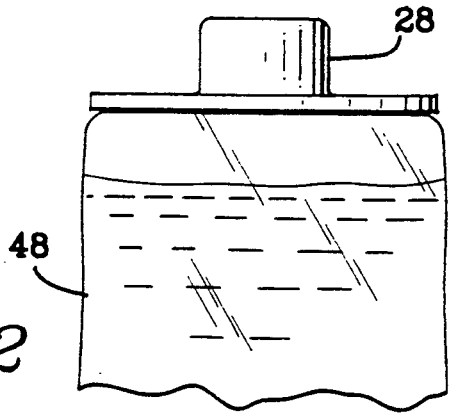

The plug means is formed from a plastic, rubber or similar material The disk shaped plug means 28 has a rupture portion 30, which is designed to rupture at shear point 37 by the leading edge 32 of the bolt means 20 is being inserted through the plug means 28 into the sleeve means 16. Rupture portion 30 may be formed as a hollow member or may be constructed from a solid core 30 as shown in FIG. 5. A bolstered portion 33 may be formed on the plug means 28 to prevent excessive wear or damage during rupturing.

After the rupture portion 30 has ruptured, a non rupture portion 34 of the plug means 28 remains sealed between the bolt means 20 and the inner circumference 36 of the bore 12. An engaging means 35, such as mating slot **35*a* and groove 35*b* may be included to prevent rotation of the plug means 28** as the ruptured portion is being ruptured to reduce the wear on the plug means.

A belt engaging face 31 of the disk shaped plug means 28 typically includes a funnel means 29 to guide the leading edge of the bolt means 32 towards the rupture portion 30 as the bolt means 20 is being forced to the sleeve means. The funnel means may be an angled surface 38, a curved shoulder 40, a stepped shoulder 42 or other well known funnel configurations. The bolstered shoulder configuration also reduces wear of the plug means 28 during rupturing.

The plug means 28 can also be formed as a plurality of axially aligned disks **44*a*, 44*b* and 44*c*. The disk shaped plug means 28 ca also include flexible radially extended portions 46 which, when the plug means 28 are inserted in the bore 12, will deform to be closely parallel to the inner circumference of the bore 36. Both of these configurations further limit flow of the grout means 23 past the plug means 28**.

The grout means 23 is usually applied by inserting a grout container 48 into the bore 12 after the sleeve means 16 and the plug means 28. The bolt means 20 is thereupon inserted into the bore 12, which crush the walls of the flexible grout container 48, dispensing the grout. Alternately the plug means 28 and the grout container may be formed as a combined unit. The plug means may be inserted in the container with the grout or may be attached to the exterior of the grout container.

It may be desired to retain the grout container in position before the bolt means 20 is inserted into the bore 12. To accomplish this, a grout container capture means 50 may be formed in a recess 52 formed in the face of the plug means 31. When the grout container 48 is force into the bore 12, a rigid clip ring 54 which is formed on the grout container will displace a flexible capture ring 56 formed in the recess 52.

Once the rigid clip ring 54 moves past the flexible capture ring 56, the rigid clip ring, along with the grout container 48, will be securely held in position. Alternately, the rigid capture ring 54 may be mounted in the recess 52 while the flexible capture ring 56 is attached to the grout container 48, to accomplish the same results.

Even though this disclosure has described the sleeve means 16 being inserted into the bore 12 prior to the insertion of the grout container 48; it is to be understood that either the sleeve means 16 or the grout container 48 can be placed in the bore 12 first.

Having described the invention, what is claimed is:

1. An apparatus comprising:

bolt means for insertion into a bore formed in a geological structure, the bore having an outer circumferential wall;

sleeve means for securing a first axial portion of the bolt means to a first portion of the circumferential wall;

grout means for securing a second axial portion of the bolt means to a second portion of the circumferential wall; and substantially disk shaped plug means for limiting a passage of the grout means between the first axial portion of the bolt means and the first portion of the circumferential wall wherein said plug means further comprises a retainer means for suspendingly retaining a grout container in the bore prior to insertion of the bolt means into the bore.

2. The apparatus as defined in claim 1, wherein the sleeve means and the disk shaped plug means are formed as a unitary member.

3. The apparatus as defined in claim 1, wherein the plug means further comprises:

funnel means for guiding the bolt means into a recess formed in the sleeve means upon insertion of the bolt means into the recess.

4. The apparatus as defined in claim 3, wherein the funnel means comprises:

a belt engaging side of the plug means which is inwardly angled.

5. The apparatus as defined in claim 3, wherein the bolt engaging side of the plug means has a curved shoulder means which forms the funnel means.

6. The apparatus as defined in claim 3, wherein the bolt engaging side of the plug means has a stepped shoulder means which forms the funnel means.

7. The apparatus as defined in claim 1, wherein the disk shaped plug means includes a plurality of axially aligned disk members.

8. The apparatus as defined in claim 1, wherein the retainer means is formed on a side face of the disk shaped plug means.

9. The apparatus as defined in claim 1, further comprising:

a flexible radial extension of the disk shaped plug means, whereupon insertion of the plug into the bore displaces the flexible portion parallel to the circumferential wall of the bore, forming the retainer means.

10. The apparatus as defined in claim 1, wherein the grout container capture means is formed in a recess in a side face of the plug means.

11. The apparatus as defined in claim 10, wherein the grout container capture means comprises;

a flexible capture ring formed in the recess; and a rigid clip ring formed on the grout container.

12. The apparatus as defined in claim 10, wherein the grout container capture means comprises:

a rigid capture ring formed in the recess; and a flexible clip ring formed on the grout container.

13. The apparatus means as defined in claim 1 further comprising:

a rupture portion of the disk, where insertion of the bolt through the plug means will rupture the rupture portion while maintaining the prevention of the passage of grout.

14. An apparatus comprising:

sleeve means for fitting within a bore formed in a geological structure;

bolt means to be inserted within a recess formed in the sleeve means, wherein a first axial portion of the bolt is attached to a first portion of the bore by the sleeve means;

grout means for attaching a second axial portion of the bolt, separate from the first axial portion, to a second portion of the bore; and a substantially disk shaped plug means for restricting a flow of the grout means from the second axial portion to the first axial portion wherein said plug means further comprises a retainer means for suspendingly retaining a grout container in the bore prior to insertion of the bolt means into the bore.

15. The apparatus as defined in claim 14, wherein the sleeve means and the disk shaped plug means are formed as a unitary member.

16. The apparatus as defined in claim 14, wherein the plug means further comprises:

funnel means for guiding the bolt means into a recess formed in the sleeve means upon insertion of the bolt means into the recess.

17. The apparatus as defined in claim 16, wherein the funnel means comprises:

a bolt engaging side of the plug means which is inwardly angled.

18. The apparatus as defined in claim 16, wherein the bolt engaging side of the plug means has a curved shoulder means which forms the funnel means.

19. The apparatus as defined in claim 16, wherein the bolt engaging side of the plug means has a stepped shoulder means which forms the funnel means.

20. The apparatus as defined in claim 14, wherein the disk shaped plug means includes a plurality of axially aligned disk members.

21. The apparatus as defined in claim 14, wherein the retainer means is formed on a side face of the disk shaped plug means.

22. The apparatus as defined in claim 14, further comprising:

a flexible radial extension of the disk shaped plug means, whereupon insertion of the plug into the bore displaces the flexible portion parallel to the circumferential wall of the bore, forming the retainer means.

23. The apparatus as defined in claim 14, wherein the grout container container capture means is formed in a recess in a side face of the plug means.

24. The apparatus as defined in claim 23, wherein the grout container capture means comprises;

a flexible capture ring formed in the recess; and a rigid clip ring formed on the grout container.

25. The apparatus as defined in claim 23, wherein the grout container capture means comprises:

a rigid capture ring formed in the recess; and a flexible clip ring formed on the grout container.

26. The plug means as defined in claim 14 further comprising:

a rupture portion of the disk, where insertion of the bolt through the plug means will rupture the rupture portion while maintaining the prevention of the passage of grout.

27. The plug means as defined in claim 26, further comprising:

a bolstered portion formed in the side wall of the plug means to prevent rupture of non-rupture portions of the disk while the rupture portions rupture.

28. The apparatus a defined in claim 14, further comprising:

engaging means preventing relative rotation between the sleeve means and the disk shaped plug means when the bolt is being inserted into the sleeve.

29. The apparatus as defined in claim 14, wherein the first axial portion is deeper in the bore than the second axial portion, when the bolt means is inserted into the bore.

30. The apparatus as defined in claim 14, wherein the grout is contained in a fragmentable container prior to insertion of said bolt means into the bore.

31. The apparatus as defined in claim 30, wherein a plug is incorporated in the grout container.

32. An apparatus comprising:

sleeve means for fitting within a bore formed in a geological structure;

bolt means to be inserted within a recess formed in the sleeve means, wherein a first axial portion of the bolt is attached to a first portion of the bore by the sleeve means;

grout means for attaching a second axial portion of the bolt, separate from the first axial portion, to a second portion of the bore;

a substantially disk shaped plug means for restricting a flow of the grout means from the second axial portion to the first axial portion;

a rupture portion of the disk, where insertion of the bolt through the plug means will rupture the rupture portion while limiting the passage of grout between the first and the second axial portions; and a bolstered portion formed on a bolt engaging side of the plug means to prevent rupture of non-rupture portions of the disk while the rupture portions rupture.

33. An apparatus comprising:

sleeve means for fitting within a bore formed in a geological structure;

bolt means to be inserted within a recess formed in the sleeve means, wherein a first axial portion of the bolt is attached to a first portion of the bore by the sleeve means;

grout means for attaching a second axial portion of the bolt, separate from the first axial portion, to a second portion of the bore; and a substantially disk shaped plug means for restricting a flow of the grout means from the second axial portion to the first axial portion wherein said plug means and said sleeve means further comprise engaging means for restricting relative rotation between the sleeve means and the disk shaped plug means when the bolt is being inserted into the sleeve.

34. The apparatus as defined in claim 33, wherein the engaging means consists of a slot, formed on either the sleeve means or the plug means, and a mating groove formed on the other means.

* * * * *